US008138406B2

(12) United States Patent
Vinciguerra

(10) Patent No.: US 8,138,406 B2
(45) Date of Patent: Mar. 20, 2012

(54) EXTENSION FOR GUITAR EFFECTS PEDAL BOARD

(76) Inventor: Chris Vinciguerra, Mountain View, CA (US)

( * ) Notice: Subject to any disclaimer, the term of this patent is extended or adjusted under 35 U.S.C. 154(b) by 0 days.

(21) Appl. No.: 12/813,299

(22) Filed: Jun. 10, 2010

(65) Prior Publication Data

US 2011/0303077 A1 Dec. 15, 2011

(51) Int. Cl.
*G10D 13/02* (2006.01)

(52) U.S. Cl. ..... 84/421

(58) Field of Classification Search ..... 84/421, 84/422.1, 422.2, 422.3
See application file for complete search history.

(56) References Cited

U.S. PATENT DOCUMENTS 6,723,909 B1 * 4/2004 Hooper, II ..... 84/453

OTHER PUBLICATIONS

CN2001158319Y; Chongshou; Dec. 2009. Zhang, All.*

* cited by examiner

*Primary Examiner* — Kimberly Lockett
(74) *Attorney, Agent, or Firm* — Michael A. Glenn; Glenn Patent Group

(57) ABSTRACT

A pedal board extension provides a pedal board with a platform for additional effects and/or over-sized effects. One or more U-shaped members are arranged along one edge of the extension. When the extension is mated to the pedal board, the U-shaped members engage with an end rail of the pedal board, thus securely joining the extension to the pedal board.

10 Claims, 7 Drawing Sheets

EXTENSION FOR GUITAR EFFECTS PEDAL BOARD

BACKGROUND OF THE INVENTION

1. Technical Field

The invention relates to electric guitar effects. More particularly, the invention relates to guitar effects pedal boards.

2. Description of the Background Art

Special effects are often used to color or otherwise alter the sound produced by a guitar. This inroad of technology into the forest of sound was pioneered by Les Paul in the late 1940's and early 1950's, but such effects are now most famously associated with Jimi Hendrix. It is today uncommon to find a guitar player who does not use at least some such effects to add expression to their performance. Such effects are often used in combination. For example, for certain arrangements a wah pedal and overdrive may be desired, while in other arrangements a flanger and equalization may be chosen. Each such device is colloquially referred to as a "stomp box" because it is typically actuated when the player stomps on an on/off switch with his foot. This is necessary because the player typically needs both hands to play the guitar, some of Van Halen's technique notwithstanding. As such, the routing of cables and provisioning of power to such effects, particularly for performers who must repeatedly set up and take down their equipment, has become challenging at best. To address this problem a type of rack, referred to as a "pedal board," has been marketed that provides a surface to which the effects may be mounted and that also provides both power and signal routing to minimize cable clutter. The PEDAL-TRAIN product (see FIG. 1), manufactured and marketed by PRO STAGE GEAR LLC. of Franklin, Tenn., is an exemplary guitar effects pedal board. While the pedal board is a useful adjunct to the musician's toolkit, it lacks facility with regard to oversize effects, such as wah pedals. Thus, the musician is back where he started with scattered effects and cable clutter.

SUMMARY OF THE INVENTION

An embodiment of the invention comprises a pedal board extension. The extension provides a pedal board with a platform for additional effects and/or over-sized effects. One or more U-shaped members are arranged along one edge of the extension. When the extension is mated to the pedal board, the U-shaped members engage with an end rail of the pedal board, thus securely joining the extension to the pedal board.

DETAILED DESCRIPTION OF THE INVENTION

Figure 1:
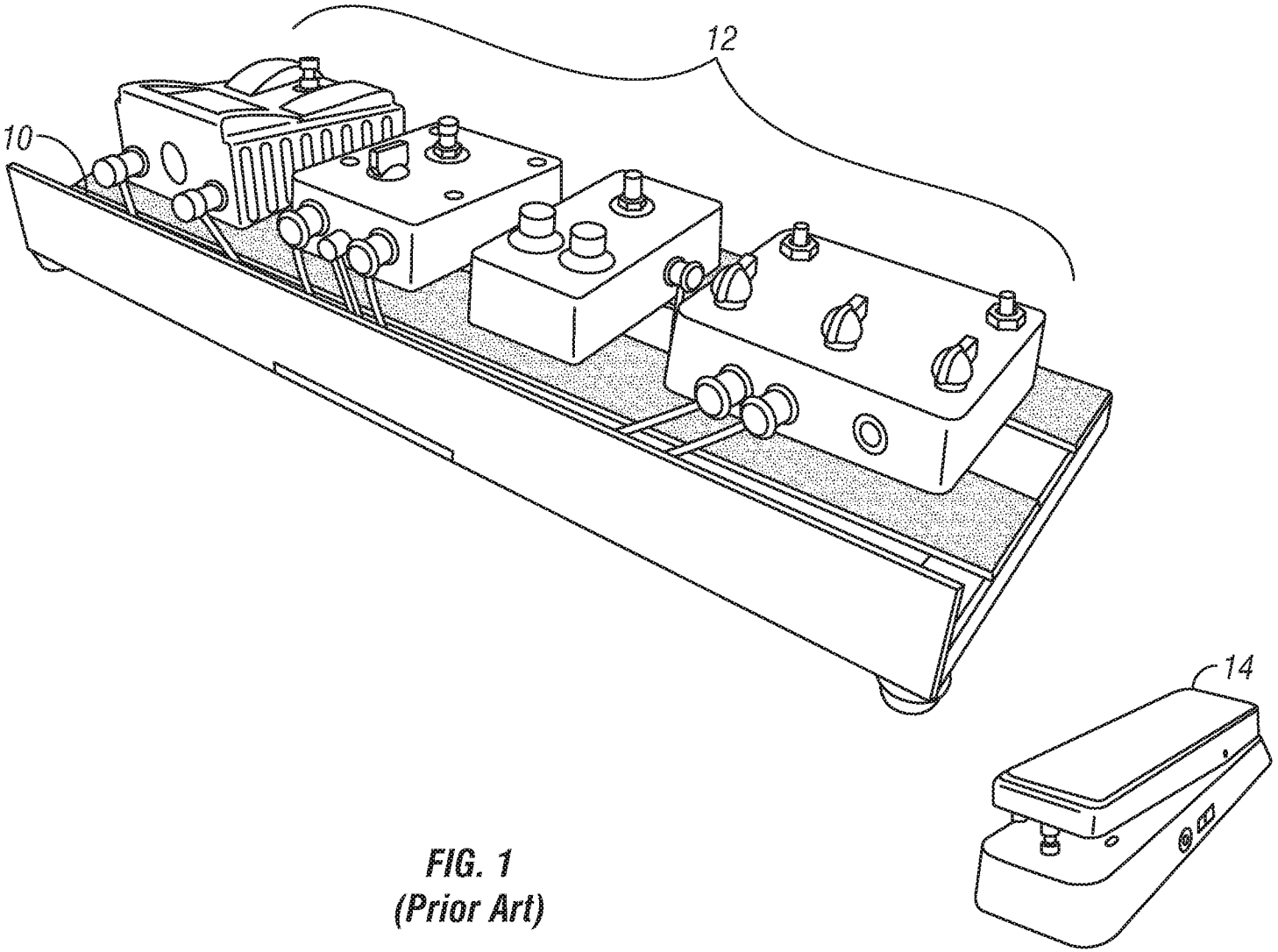
FIG. 1 (Prior Art)
FIG. 1 is a perspective view of a pedal board.

FIG. 1 is a perspective view of a pedal board 10, which is provided to organize a plurality of musical instrument effects 12. As shown, such pedal boards lack both capacity and size for certain effects, such as a wah pedal 14. An embodiment of the invention comprises a pedal board extension. The extension provides a pedal board with a platform for additional effects and/or over-sized effects. One or more U-shaped members are arranged along one edge of the extension. When the extension is mated to the pedal board, the U-shaped members engage with an end rail of the pedal board, thus securely joining the extension to the pedal board.

Figure 2:
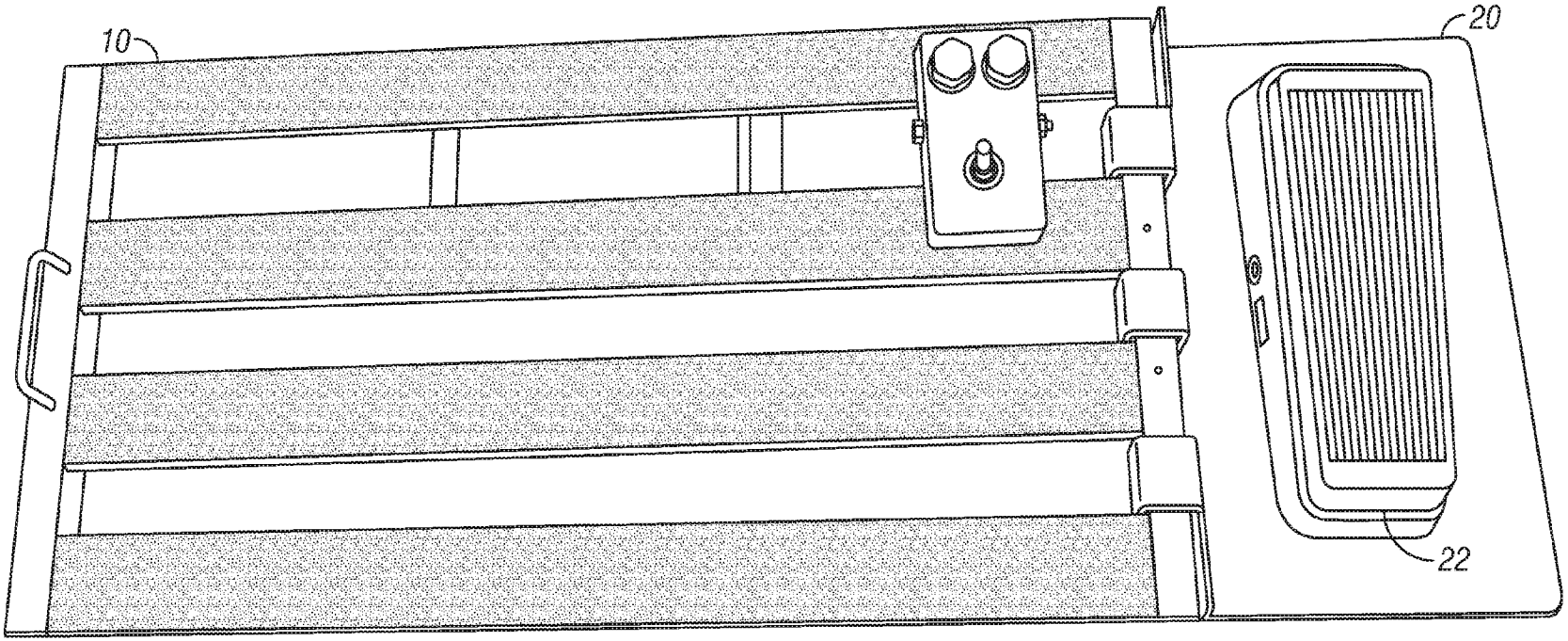
FIG. 2 is a perspective view of a pedal board incorporating a pedal board extension according to the invention.

FIG. 2 is a perspective view of a pedal board incorporating a pedal board extension according to the invention. In FIG. 2, a pedal board 10 is shown having an extension 20 in accordance with a preferred embodiment of the invention attached thereto. An effect, i.e. a wah pedal 22, is shown resting on the extension.

Figure 3:
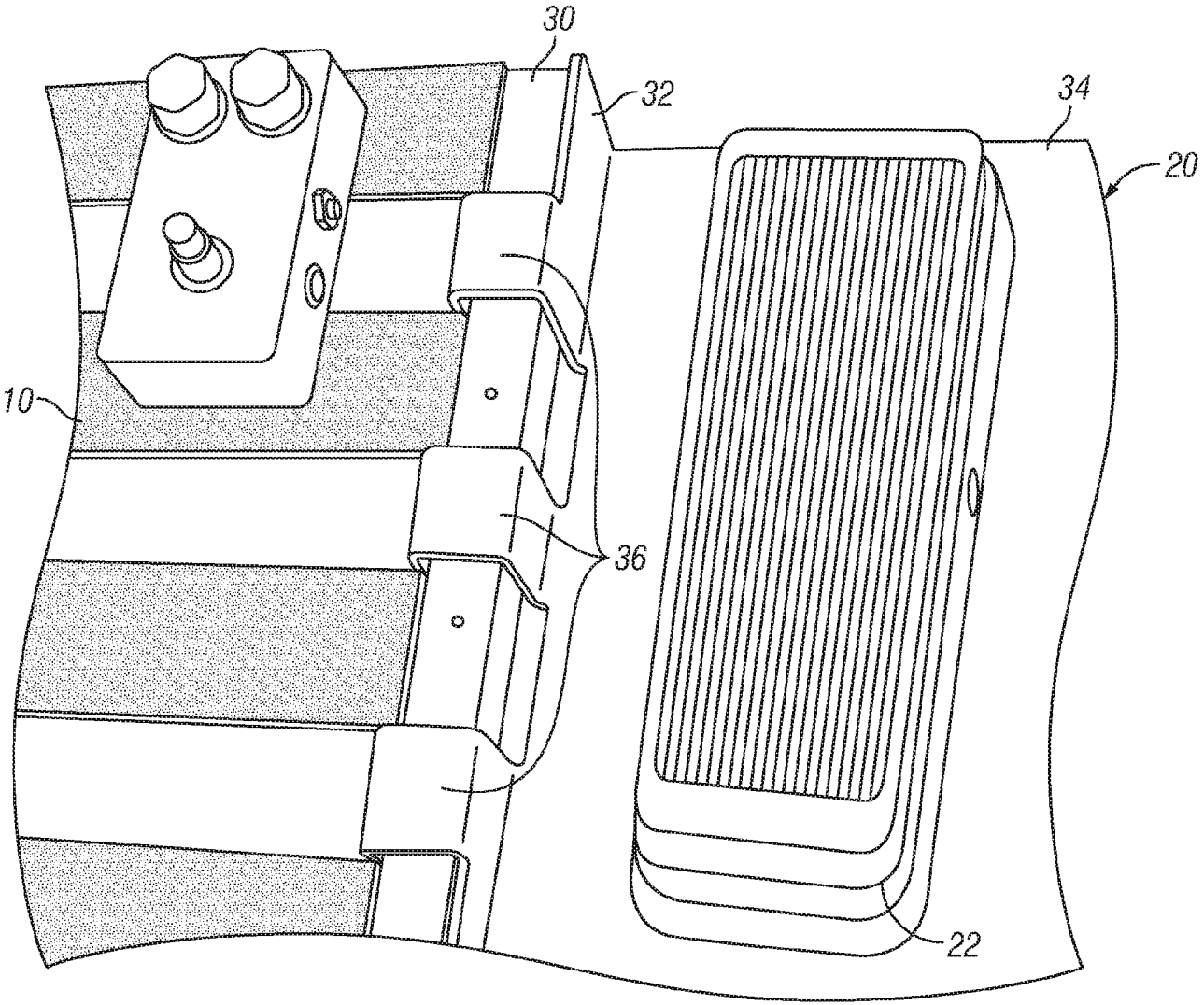
FIG. 3 is a detailed perspective view of a pedal board incorporating a pedal board extension according to the invention.

FIG. 3 is a detailed perspective view of a pedal board incorporating a pedal board extension according to the invention. In FIG. 3, the extension provides a rectangular platform 34 that defines a horizontal, planar surface for supporting one or more musical instrument effects, e.g. the wah pedal 22. In the presently preferred embodiment of the invention, two or more U-shaped members 36 are provided at an edge 32 of the extension to engage with a rectangular, tubular rail 30 which forms a side portion of the pedal board. Those skilled in the art will appreciate that the extension may be provided with a single U-shaped member or with more than two U-shaped members. Further, while a U-shaped member is shown in the figures and discussed herein with regard to a presently preferred embodiment of the invention, those skilled in the art will appreciate that the invention may be practiced with any type of pedal board, e.g. a pedal board having a round tubular rail; having a solid, flat member instead of a rail, etc.

Figure 4:
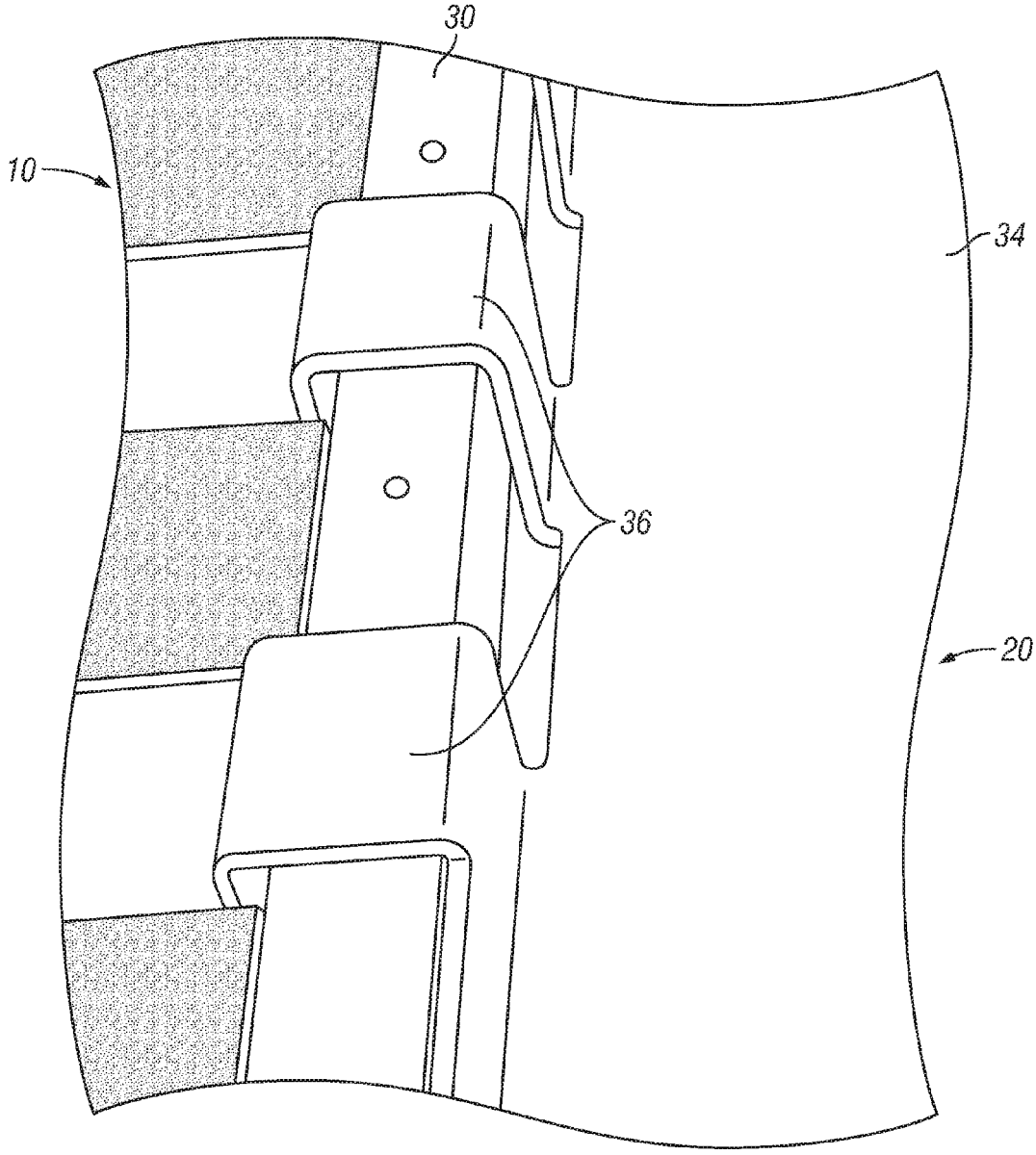
FIG. 4 is a first detailed perspective view of a pedal board rail and pedal board extension clips according to the invention.

FIG. 4 is a first detailed perspective view of a pedal board rail and pedal board extension clips according to the invention. In FIG. 4, each U-shaped member has a first segment joined to and projecting substantially upward from an edge of the extension platform. The first segment has a lower and an upper portion, the upper portion of the first segment terminating at a first portion of a second segment. The second segment projects away from the platform substantially parallel thereto. The second segment has a second portion terminating at a first portion of a third segment. The third segment projects downward from the second segment substantially parallel to the first segment. The three segments collectively define the U-shape of said U-shaped member. Those skilled in the art will appreciate that the member need not be U-shaped. Rather, it is only necessary that the member be configured to engage with a left or right edge of the pedal board. In the embodiment described herein, U-shaped members are provided for engagement with a rectangular, tubular rail portion of the pedal board. In any configuration, the dimensions of the member should be such that the member securely engages with the left or right edge of the pedal board. In the case of a U-shaped member, the spacing between the first and third segments, as established by the second segment, should be sufficient to allow the U-shaped member to engage securely, but preferably removably, with the rectangular, tubular rail at the left or right edge of the pedal board.

The pedal board extension may include a mechanism (not shown) for fastening the extension to the pedal board at least one of the U-shaped members. This mechanism may comprise any of a clamp, a bolt, a pin, a clevis, and a strap.

Figure 5:
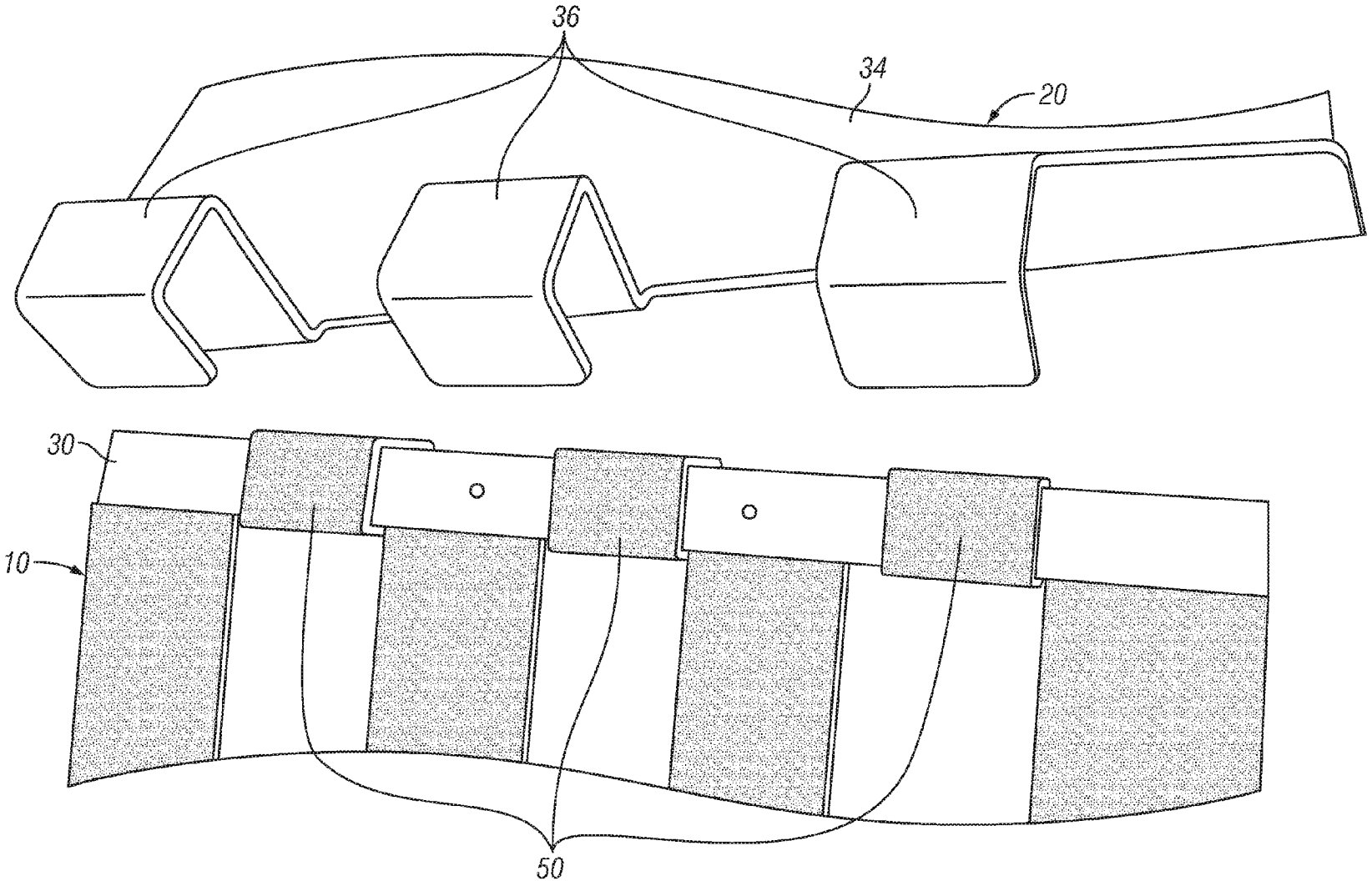
FIG. 5 is a second detailed perspective view of a pedal board rail and pedal board extension clips according to the invention.

FIG. 5 is a second detailed perspective view of a pedal board rail and pedal board extension clips according to the invention. As can be seen in FIG. 5, the U-shaped members are spaced apart from each other along the platform edge for mating engagement thereof with the rectangular, tubular end rail of said pedal board to join said extension securely to said pedal board. In this embodiment of the invention, the rectangular, tubular rail is fitted with a cushioning material 50 at the point of engagement with the U-shaped member. This provides a snug fit of the extension to the pedal board.

Figure 6:
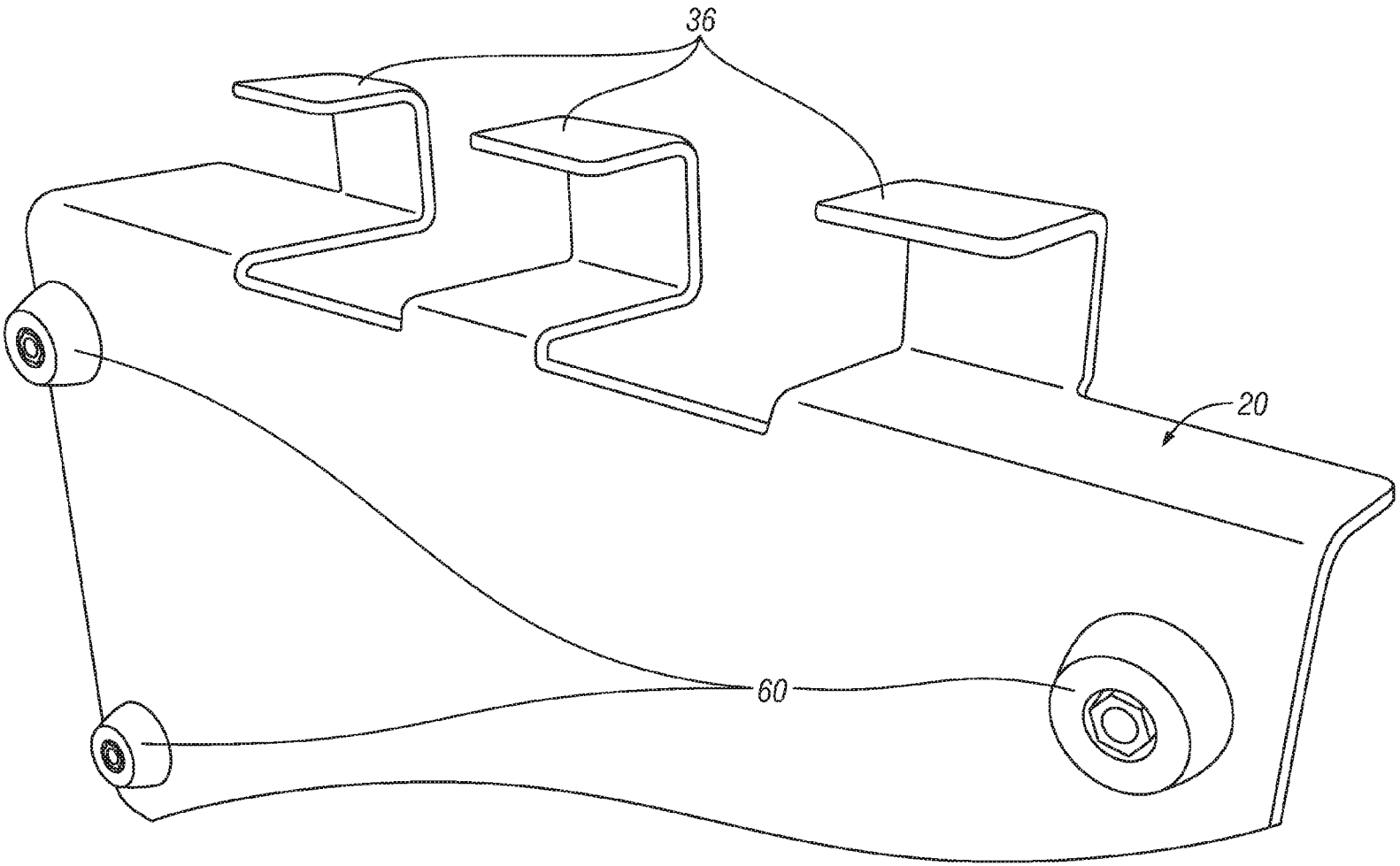
FIG. 6 is a detailed perspective view of a bottom portion of a pedal board extension according to the invention.

FIG. 6 is a detailed perspective view of a bottom portion of a pedal board extension according to the invention. FIG. 6, shows a plurality of feet 60 positioned on a bottom portion of the extension. The feet serve both to provide a stable support for the extension and to establish the height of the platform. In some embodiments, the feet may be adjustable to allow a user to set the height of the platform as desired.

In one embodiment of the invention, the U-shaped members are substantially evenly spaced apart and symmetrically located along the extension edge relative to the rectangular, tubular end rail of the pedal board to join the extension at either of a first and a second pedal board end rail at either of a corresponding first side and second side of the pedal board. This is an ambidextrous embodiment of the invention that permits the extension to be fitted to either of the left or right side of the pedal board. Because the pedal board extension can be joined to the pedal board at each of said first and said second pedal board sides, two extensions may be joined to the pedal board.

In another embodiment of the invention, a hinge (not shown) is positioned between each U-shaped member and the extension edge. In this embodiment each U-shaped member, alone or collectively, is operable between a folded position in which the platform of the extension is folded to the pedal board and an extended position in which the platform is positioned alongside the pedal board. This arrangement allows easy transport of the pedal board and extension pair when the extension platform is folded to the pedal board.

Finally, yet another embodiment of the invention provides cables and/or connectors (not shown) that extend a power source associated with the pedal board to the extension and/or that route signal wiring from the extension to the pedal board.

Figure 7:
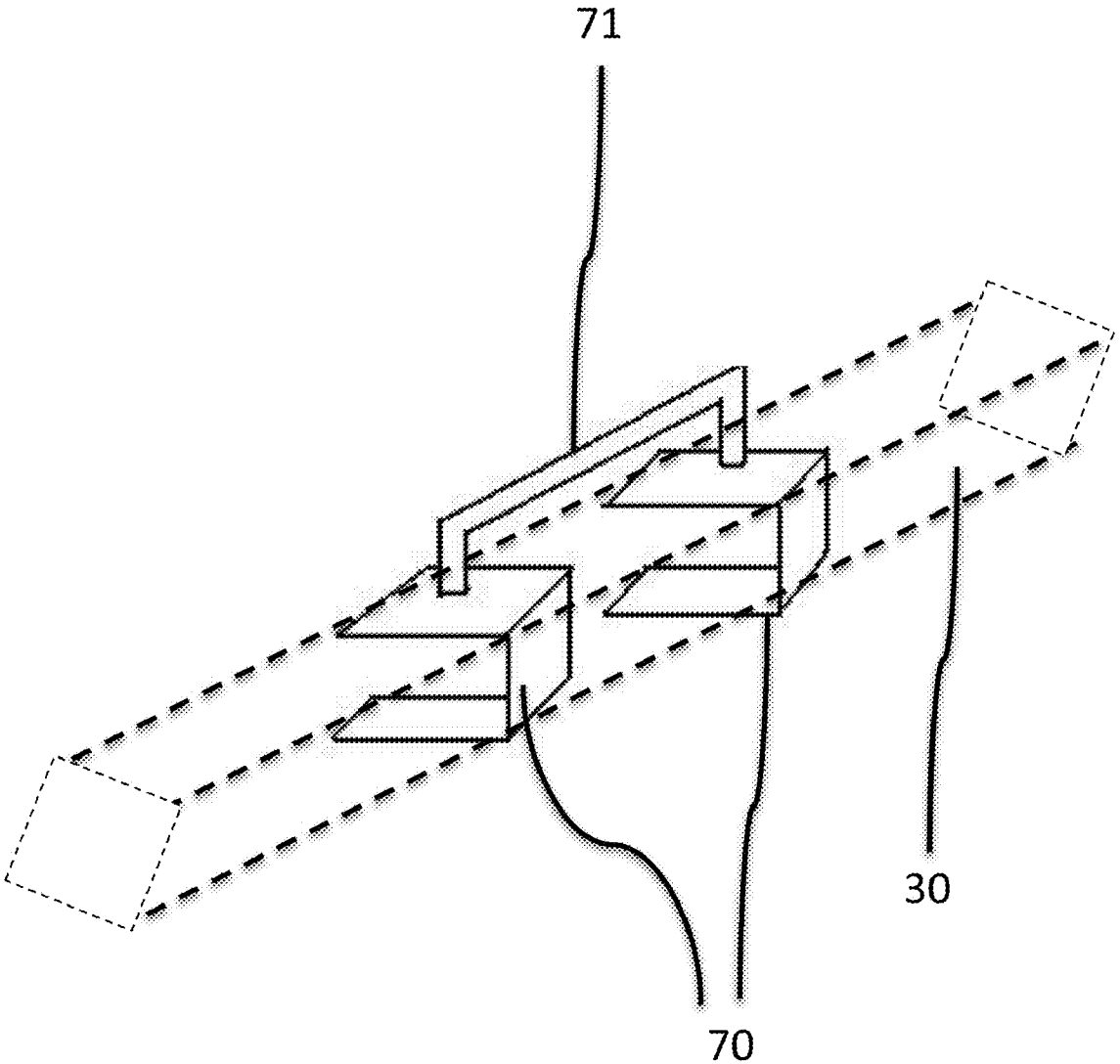
FIG. 7 is a perspective view of a pedal board handle according to the invention.

FIG. 7 is a perspective view of a pedal board handle according to the invention. Using the principle taught above, two C-shaped members 70 are used to secure a handle 71 to the pedal board. In this embodiment, the C-shaped members engage with the pedal board rail 30. A handle bridges the C-shaped members.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A pedal board extension, comprising:

a rectangular platform defining a horizontal, planar surface for supporting one or more musical instrument effects;

at least two U-shaped members, each member having a first segment joined to and projecting substantially upward from an edge of said platform, said first segment having a lower and an upper portion, said upper portion of said first segment terminating at a first portion of a second segment, said second segment projecting away from said platform substantially parallel thereto, and said second segment having a second portion terminating at a first portion of a third segment, said third segment projecting downward from said second segment substantially parallel to said first segment, wherein said three segments collectively define the U-shape of said U-shaped member;

wherein said U-shaped members are spaced apart from each other along said platform edge for mating engagement thereof with a rectangular, tubular end rail of said pedal board to join said extension securely to said pedal board.

2. The pedal board extension of claim 1, at least one of said U-shaped members further comprising a mechanism for fastening said extension to said pedal board.

3. The pedal board extension of claim 2, said mechanism comprising any of a clamp, a bolt, a pin, a clevis, and a strap.

4. The pedal board extension of claim 1, wherein said U-shaped members are substantially evenly spaced apart and symmetrically located along said extension edge relative to said rectangular, tubular end rail of said pedal board to join said extension at either of a first and a second pedal board end rail at either of a corresponding first side and second side of said pedal board.

5. The pedal board extension of claim 4, wherein a pedal board extension is joined to said pedal board at each of said first and said second pedal board sides, wherein two extensions are joined to said pedal board.

6. The pedal board extension of claim 1, further comprising:

a cushioning material placed said rectangular, tubular end rail of said pedal board at a point of engagement with each said U-shaped member.

7. The pedal board extension of claim 1, further comprising:

a plurality of feet positioned on a bottom portion of said extension.

8. The pedal board extension of claim 7, wherein said feet further comprise an adjustment mechanism for setting the height of said platform as desired.

9. The pedal board extension of claim 1, further comprising:

a hinge between each said U-shaped member and said extension edge, wherein each said U-shaped member, alone or collectively, is operable between a folded position in which said platform is folded to said pedal board and an extended position in which said platform is positioned alongside said pedal board.

10. The pedal board extension of claim 1, further comprising:

cables and/or connectors associated with said extension and configured to extend a power source associated with said pedal board to said extension and/or to route signal wiring from said extension to said pedal board.

* * * * *